US005449309A

United States Patent [19]

McCarty

[11] Patent Number: 5,449,309

[45] Date of Patent: Sep. 12, 1995

[54] SUPPORT MECHANISM FOR WATER SKIING

[76] Inventor: James A. McCarty, 1759 Sattler Dr., Concord, Calif. 94519

[21] Appl. No.: 371,450

[22] Filed: Jan. 11, 1995

Related U.S. Application Data

[63] Continuation of Ser. No. 178,106, Jan. 6, 1994, abandoned.

[51] Int. Cl.[6] ..... B63B 35/85

[52] U.S. Cl. ..... 441/69; 114/253

[58] Field of Search ..... 2/311-318; 441/68, 69, 113; 114/253, 254, 39.2, 242; 182/3-5, 133, 136, 8; 294/25, 149; 224/218, 250, 1

[56] References Cited

U.S. PATENT DOCUMENTS

| | | | |
|---|---|---|---|
| 3,494,319 | 2/1970 | Dunlap | 441/69 |
| 4,263,685 | 4/1981 | Neuscheler | 9/310 |
| 4,280,240 | 7/1981 | Neuscheler | 9/310 |
| 4,630,563 | 12/1986 | Pertramer | 114/39.2 |
| 4,687,074 | 8/1987 | Green | 182/3 |
| 4,712,498 | 12/1987 | Oser | 114/39.2 |
| 4,720,279 | 1/1988 | Fritschen et al. | 441/69 |
| 4,759,306 | 7/1988 | McKenzie | 294/25 |

FOREIGN PATENT DOCUMENTS

| | | | |
|---|---|---|---|
| 2306717 | 11/1976 | France | 114/39.2 |
| 2601879 | 1/1988 | France | 182/3 |

*Primary Examiner*—Edwin L. Swinehart

*Attorney, Agent, or Firm*—Bielen, Peterson & Lampe

[57] ABSTRACT

A support mechanism for holding a water skier to a water skiing tow bar utilizing a harness capable of being connected to the water skier. The harness includes an element which extends a certain distance relative to the water skier, preferably along the front portion of the water skier. A link connects to the element and may be slidable or movable along the certain dimension of the element. A line is fixed to the movable element and possesses pre-determined degree of flexibility to wrap about a tow bar and alleviate the effort expended by a skier holding on to the tow bar.

6 Claims, 1 Drawing Sheet

SUPPORT MECHANISM FOR WATER SKIING

This is a continuation of application Ser. No. 08/178,106, filed 6 Jan. 1994, now abandoned.

BACKGROUND OF THE INVENTION

The present invention relates to a novel and useful support mechanism for holding a water skier to a tow bar Water skiing requires a water skier to hold on to a tow bar while being towed at a high rate of speed by a motor boat. During normal water skiing activities through a straight or slalom course, the tow bar is tightly grasped by the water skier. However, where the water skier must be towed to a certain area of calmer water or areas where the water is free of obstructions, a rather lengthy tow is required. In the past, the water skier holding on to a tow bar tires during this maneuver and is unable to ski properly when the water skiing area is reached.

U.S. Pat. Nos. 4,263,685 and 4,280,240 depict water skiing tow lines engagement devices which employ pivoting pins that complicate engagement and disengagement procedures.

A mechanism which aids the water skier in movement to an area where active water skiing is to take place would be a notable advance in the field of water sports.

SUMMARY OF THE INVENTION

In accordance with the present invention a novel and useful support mechanism for holding a water skier to a tow bar is herein provided.

A support mechanism of the present invention includes a harness capable of being connected to the water skier. The harness may take the form of a waist belt, a shoulder strap, a water skiing vest, and the like. The harness is formed with an element extending along a certain dimension relative to the water skier. The element may take the form of a band, cable, strap, or the like and may be accessible at the front of the water skier while the water skier is holding a water skiing tow bar.

The present invention also includes a link connected to the element of the harness and which is fixed or movable along the certain dimension of the element. The link may take the form of a loop or ring which extends over the element and slides along the certain dimension of the element. The link may be formed with a plate which projects toward the water skiing tow bar.

A line fixes to the movable element and possesses sufficient flexibility to wrap about the tow bar. The line is also limited in length to prevent knotting or snagging of the same on the tow bar. The line and link may be formed into a unitary member to permit sliding of the link portion along the harness element. Alternatively, a line may be fixed to a separate link in various ways, including fixation to a link plate when the link includes the same. In the latter case, the line would include an enlargement which is incapable of passing through a hole in the plate. That is to say, the line would extend through the opening except for the enlargement portion of the line. The line may be easily wrapped around the tow bar and held by the water skier's hand such that release of the hand pressure on the wrapped line will immediately release the line from the tow bar.

It may be apparent that a novel and useful support mechanism for holding a water skier to a tow bar has been described.

It is therefore an object of the present invention to provide a support mechanism for holding a water skier to a tow bar which is relatively simple to manufacture and use.

It is another object of the present invention to provide a support mechanism for holding a water skier to a tow bar which may be quickly attached to the tow bar such that the pulling force exerted by the tow bar greatly relieves the skier of the necessity of holding the tow bar with the water skier's hands, and may be easily released by simply reducing the pressure of the water skier's hand on the support mechanism from the tow bar without releasing the tow bar.

A further object of the present invention is to provide a support mechanism for holding a water skier to a tow bar which exerts a pulling force on the water skier along the line of travel of the water skier relative to the water.

A further object of the present invention is to provide a support mechanism for holding a water skier to a tow bar which is safe to operate and prevents mishaps due to tiring and fatigue of the water skier during certain aspects of water skiing.

The invention possesses other objects and advantages especially as concerns particular characteristics and features thereof which will become apparent as the specification continues.

For a better understanding of the invention reference is made to the following detailed description of the preferred embodiments thereof which should be reference to the prior described drawings.

DETAILED DESCRIPTION OF THE PREFERRED EMBODIMENTS

Various aspects of the present invention will evolve from the following detailed description of the preferred embodiments thereof which should be taken in conjunction with the hereinbefore described drawings.

Figure 1:
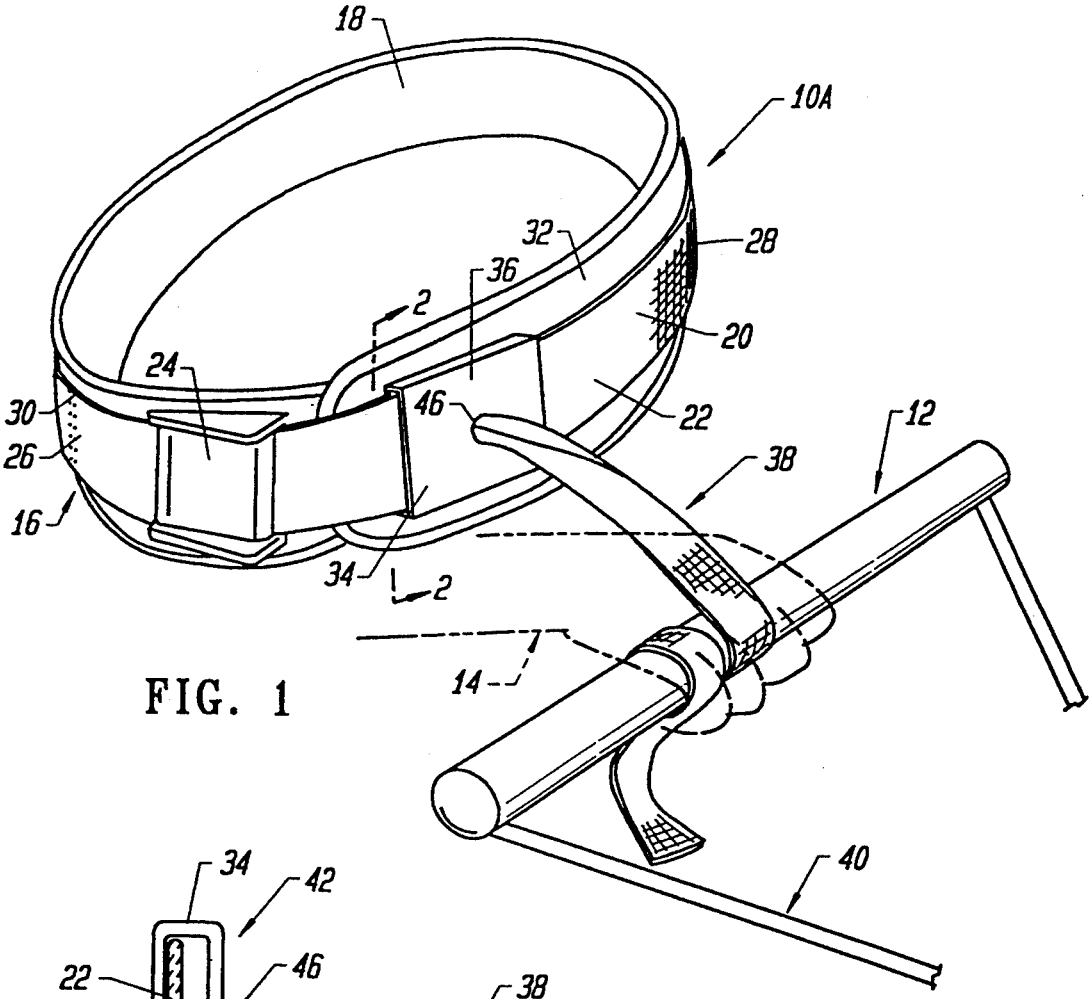
FIG. 1 is a top right perspective view of an embodiment of the present invention showing the line portion wrapped about a water skiing tow bar.
Figure 2:
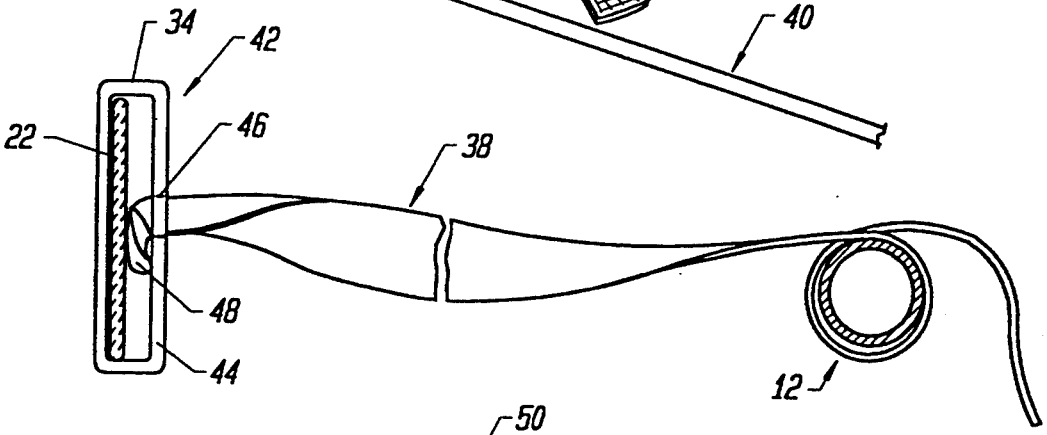
FIG. 2 is a sectional view taken along line 2—2 of FIG. 1.

The invention as a whole is shown in the drawings by reference character 10 followed by an upper case letter to distinguish particular embodiments thereof. The support mechanism 10A, FIG. 1, is intended for holding a water skier to a tow bar 12. The water skier's hand 14 is depicted in phantom on FIG. 1 in this regard. Mechanism 10A includes as one of its elements a harness 16 having a belt 18 which is intended for extending around the waist of the water skier. Attached to belt 16 is an element 20 which includes a strap 22 that is capable of passing through a buckle 24 held to belt 18 by strap 26. Strap 22 is fastened to belt 18 at sew point 28. Strap 26 is also held to belt 18 by sew point 30. Strap 22 is, thus, separated from surface 32 of belt 18.

Link 34 connects to strap 22 of element 20 and may be fixed or slidable relative to the same along directional arrow 36 as shown in FIG. 1. Link 34 is constructed with a plate 44 the purpose of which will be discussed hereinafter. Link 34 may take other forms capable of sliding along strap 22.

The present invention also encompasses a line 38 which is shown in the form of a flattened cloth structure such as a nylon webbing. Line 38 connects to movable link 34 and is capable of extending outwardly from element 20. Line 38 exhibits a degree of flexibility to wrap about tow bar 12 and to be held to the same by the hand 14 of the water skier. Of course, tow bar 12 is connected to a towing boat (not shown) by plurality of tow lines 40 (partially depicted in FIG. 1).

Joining means 42 is also shown in the present invention for fastening line 38 to link 34. Link 34 having plate 44 further possesses an opening 46 through plate 44. Line 38 is formed with an enlargement 48 that is incapable of passing through opening 46 of plate 44 such that line 38 may extend outwardly from link 34. Enlargement 48 does not interfere with the movement of link 34 along strap 22 of element 20. Of course, other fasteners may be employed to hold line 38 to link 34.

Figure 3:
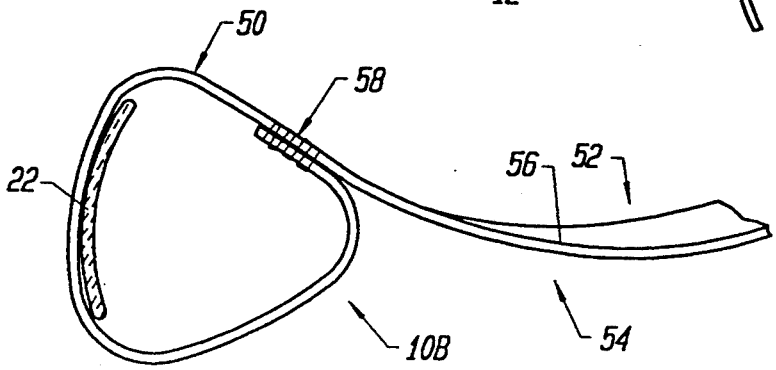
FIG. 3 is a side elevational view of another embodiment of the present invention.

Turning now to FIG. 3, it may be observed that another embodiment 10B of the support mechanism of the present invention is illustrated. Mechanism 10B includes a link 50 and a line 52 which are formed as a unitary structure 54. Link 50 and line 52 evolve from a contiguous web 56. Line 50 of structures 54 begins at sew point 58. Link 50 encircles strap 22 of element 20. Again, line 50 is free to travel along strap 22 during water skiing operations.

In operation, the user frictionally wraps line 38 around tow bar 12 while water skiing in order to relieve tension on hand 14, as well as the arms, shoulders and back (particularly the lower back) of the water skier. Line 38 or line 52 is sized to achieve such relief and to prevent snagging of line 38 or 52 on tow bar 12. The water skier would employ the support mechanism 10A or 10B when traveling on water skis from an undesirable water skiing area to a desirable water skiing area. During such time, lines 38 or 52 would transmit the pulling force of tow bar 12 directly to harness 16. Thus, the water skier conserves energy for active water skiing upon arrival at a desirable water skiing area. Lines 38 or 56 are easily wrapped about tow bar 12 and just as easily removed by simply reducing the pressure of the hand 14 on tow bar 12 without releasing the tow bar. Lines 38 or 56 are of a length which would obviate snagging or knotting of the same to insure a complete release at the proper time. Links 34 or 50 are slidable along element 20 to direct the pulling force of tow bar 12 to the water skier at a central position relative to the body of the water skier.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is

1. A support mechanism for exerting a pulling force on a water skier through a tow bar, comprising:

a. a harness capable of being connected to the torso of the water skier, said harness including an element extending along a certain dimension relative to the water skier;

b. a link connected to-said element of said harness; and c. a line having a first end portion and a second bitter end portion, said first end portion of said line being fixed to said link, said line possessing sufficient flexibility to wrap about a tow bar at said second bitter end portion there, said line being of a certain length to permit the exertion of pressure thereon by the hand of the water skier to cause engagement of the line with the tow bar and to preclude snagging and permit release of said line from the tow bar when the pressure of the hand of the water skier is released.

2. The mechanism of claim 1 in which said link is a closed loop encircling said harness element.

3. The mechanism of claim 2 in which said closed loop includes a plate and joining means for fastening said line to said plate.

4. The mechanism of claim 3 in which said joining means includes an opening in said plate and said line further includes an enlargement sized to preclude passage through said opening in said plate.

5. The mechanism of claim 1 in said link and said line are a unitary member.

6. The mechanism of claim 1 in which said link is movable along said certain dimension of said element.

* * * * *